United States Patent [19]

Tomlinson et al.

[11] Patent Number: 4,846,863

[45] Date of Patent: Jul. 11, 1989

[54] SEPARATION OF HYDROCARBON MIXTURES

[75] Inventors: Terence R. Tomlinson, Stockport; Bogdan Czarnecki, Sale, both of Great Britain

[73] Assignee: Costain Petrocarbon Limited, Manchester, United Kingdom

[21] Appl. No.: 158,264

[22] Filed: Feb. 18, 1988

[30] Foreign Application Priority Data

Feb. 18, 1987 [GB] United Kingdom ..... 8703731

[51] Int. Cl.[4] ..... F25J 3/02

[52] U.S. Cl. ..... 62/24; 62/39

[58] Field of Search ..... 62/24, 39

[56] References Cited

U.S. PATENT DOCUMENTS

| | | | |
|---|---|---|---|
| 3,607,963 | 9/1971 | Danneil et al. | 62/24 |
| 4,278,457 | 7/1981 | Campbell et al. | 62/24 |
| 4,657,571 | 4/1987 | Gazzi | 62/23 |
| 4,676,812 | 6/1987 | Kummann | 62/24 |
| 4,698,081 | 10/1987 | Aghili | 62/24 |

FOREIGN PATENT DOCUMENTS

| | | |
|---|---|---|
| 1477785 | 6/1977 | United Kingdom . |
| 2146751 | 4/1985 | United Kingdom . |

*Primary Examiner*—Ronald C. Capossela

*Attorney, Agent, or Firm*—Browdy and Neimark

[57] ABSTRACT

In the method of separating a methane-containing light gas from a feed gas containing heavier hydrocarbons by (i) cooling the feed gas at superatmospheric pressure to partially condense it, (ii) separating a first condensate from the uncondensed gas, (iii) rectifying the uncondensed gas to produce the light gas and a second condensate (preferably by further cooling the uncondensed gas in a refluxing heat exchanger), and (iv) stripping at least one of the condensates in a distillation column to obtain an overhead stream and a liquid product stream, the power requirement is reduced by providing at least part of the cooling for step (i) by expanding at least a part of the feed gas in a turbo-expander which provides energy for compression of product gas comprising said light gas and/or uncondensed gas from the overhead from the distillation column.

16 Claims, 2 Drawing Sheets

Figure 1:
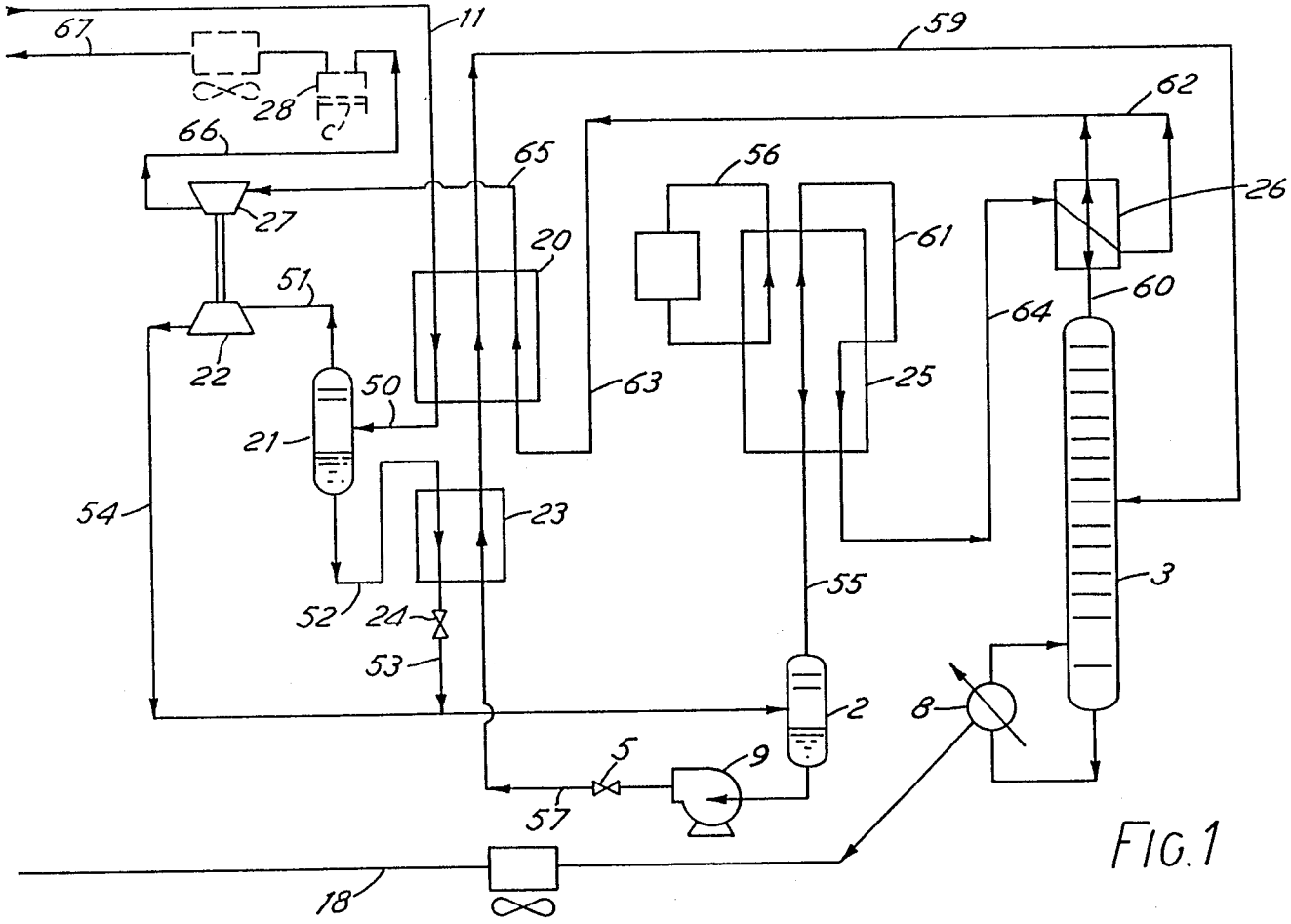

RESIDUE GAS
FEED
CONDENSATE
PROPANE/BUTANE
101
102
103
104
105
106
107
108
109
110
111
112
113
114
115
116
117
118
119
120
121
122
123
124
126
127
128
129
130
131
132
133
134

SEPARATION OF HYDROCARBON MIXTURES

This invention relates to the separation of gas mixtures which contain methane and higher hydrocarbons to provide a light gas containing methane and a liquid stream. The invention is particularly applicable to the recovery of natural gas liquid (NGL) and liquefied petroleum gas (LPG) from naturally occurring or synthetic hydrocarbon streams.

One method for the recovery of NGL or LPG from a hydrocarbon gas containing lighter components such as hydrogen and/or methane is the conventional cold end expander cycle. In this case, the feed gas is cooled at superatmospheric pressure to partially condense it, and the NGL or LPG, as appropriate, is obtained from the condensate by stabilising the condensate by stripping in a distillation column. The refrigeration for the process is provided by expansion through a turbine of the uncondensed light gas obtained from the partial condensation. This expansion causes partial liquefaction of the light gas which is then supplied to the top of the distillation column for rectification. The rectified gas, which will be largely methane and/or hydrogen, is suitable for disposal as a sales gas. If the turboexpander is to provide the refrigeration for this process, a large pressure drop must be provided across it and this leads to low temperatures and pressures in the distillation column. It is power intensive to provide refrigeration to such low temperatures and furthermore the sales gas may need to be recompressed.

A recent method which provides a more efficient alternative where the sales gas is required at a pressure close to that of the feed gas is described in British patent publication No. 2146751-A. In this case the vapour from the partial condensation is supplied to a refluxing heat exchanger wherein liquid is condensed from the vapour and flows downwards in counter-current fashion in contact with the rising vapour and is recovered from the bottom of the refluxing heat exchanger and mixed with the condensate from the partial condensation. The condensate mixture is then stripped in a distillation column. In one described embodiment, the light gas, which in this case is obtained from the top of the refluxing heat exchanger, is expanded to provide refrigeration for the process and later recompressed by a compressor driven by the turbo expander. Further compression is provided to restore the light gas to feed gas pressure.

The two methods described above are examples of conventional turboexpander cycles in which a turbine is employed at the cold end of the plant where it is able to cool the gas to the lowest temperature. However, the shaft work which can be obtained from an expander is roughly proportional to the absolute temperature of the inlet gas. Thus comparatively little work is extracted from a gas by an expander employed at low temperature and therefore, when it is desired to produce the sales gas at a pressure approaching that of the feed gas, a considerable amount of external energy must be supplied to recompress the sales gas, even with the more recent process.

Furthermore, the employment of the turboexpander at the cold end can result in a wide temperature difference at that end of the process where the efficiency loss resulting from that temperature difference is greatest.

A further drawback of these processes is that they are not suitable where the feed gas is available at higher pressures, that is pressures over about 50 bar absolute.

This is because such pressures would be too close to or may even exceed the critical pressure at some point during the separation process.

It has now been found that the power requirement for a process for separating feed gas mixtures containing methane and higher hydrocarbons to form a light gas containing methane and an NGL or LPG stream, can be reduced by cooling the feed gas by expanding at least a part of that gas in a turboexpander at the warm end of the process where the temperature and pressure drop across the turboexpander are less inefficient.

In accordance with the present invention, there is provided a method for the separation of a light gas which contains methane from a feed gas stream containing heavier hydrocarbons, the method comprising (i) cooling the feed gas at superatmospheric pressure to partially condense it, (ii) separating a first condensate from the uncondensed gas, (iii) rectifying the uncondensed gas to produce said light gas, by further cooling the uncondensed gas to partially condense it by supplying it to a refluxing heat exchanger wherein liquid is condensed out of said gas and flows downwards in counter-current fashion in contact with the rising gas and is recovered from the bottom of the refluxing heat exchanger as a second condensate and said light gas is recovered from the top of the refluxing heat exchanger, and (iv) stripping at least one of said first and second condensates in a distillation column to obtain an overhead stream and a liquid product stream wherein said cooling of step (i) includes expanding at least a part of the feed gas in a turboexpander which provides energy for recompression of product gas selected from said light gas, uncondensed gas from said overhead from the distillation column and said light gas combined with uncondensed gas from said overhead.

In this process, the turboexpander is employed at the warm end of the plant, and since it operates with a higher inlet temperature more work can be extracted for recompression purposes. In this way the requirement for external work to compress the product gas to a pressure near to that of the feed gas is reduced or obviated. Furthermore as the feed gas pressure is reduced at an early stage, the process can be used where the feed gas is provided at higher pressures and even above the critical pressure.

The relatively warm inlet temperature of the gas to the turboexpander means that even if a comparatively low expansion ratio is employed, a useful amount of energy is still available for recompression of product gas. Employing the turboexpander at the warm end of the plant also means that the process is less sensitive to feed gas pressure variations than a conventional process would be because the pressure difference across the expander can be altered to accommodate such variations.

The energy from the turboexpander is employed to drive a compressor to compress product gas. The compressor may be driven either directly or indirectly e.g. via an alternator. If required, a motor may be employed to supply additional driving force to the compressor. The product gas which is compressed by the compressor may may be light gas, uncondensed gas from the overhead of the distillation column or a mixture of both. If the distillation column is operated at a lower pressure than the refluxing heat exchanger it may be desirable to use the turboexpander energy to compress the overhead before combining it with the light gas.

In one embodiment, the amount of work-expansion in the turboexpander is made as small as possible, that is, the pressure is only reduced sufficiently for it to lie below the critical envelope of the light gas in order to minimise the energy needed to recompress the product gas to a pressure approaching that of the feed gas.

In this embodiment, residual cold in the product gas fed to the compressor may advantageously be used to provide part of the cooling for step (i), by passing said product gas in indirect heat exchange with the feed gas. The product gas is conveniently thus warmed to ambient temperature. Thus, in this embodiment, step (i) is effected in part by expansion of the feed gas in said turboexpander and in part by cooling the feed gas by indirect heat exchange with product gas.

In an alternative embodiment, suitable for where the feed is at an appropriately high pressure the pressure drop across the turboexpander is made sufficient or substantially sufficient of itself to cool the feed to the required temperature for supply to the refluxing exchanger. This embodiment is most suitable for use when the product gas is not required at as high a pressure as the feed gas.

In either case, the light gas recovered from the refluxing heat exchanger is preferably employed to cool and partially condense overhead gas from the distillation column, whereby to provide at least a part, and preferably all of the column reflux. In this way, the additional cold which is present in the light gas due to the previous expansion of the feed gas in the turboexpander may be employed to provide at least a part, and in some cases all, of the reflux requirement for the distillation column. In a further preferred embodiment, the light gas is reheated in the refluxing heat exchanger by indirect heat exchanger relationship with the uncondensed gas, thereby providing cooling at the warm end of the exchanger, prior to being used to cool and condense overhead gas from the distillation column. Preferably the uncondensed overhead from the distillation column is combined with the light gas prior to compression in the compressor, although it may be recycled and combined with the feed gas after that feed gas has been expanded in the turboexpander.

Conveniently the first and second condensates will be combined to form a mixture which provides the feed to the distillation column. Alternatively, however, only one condensate may be stripped in the distillation column, or each condensate may be stripped in separate distillation columns. Preferably the feed to the distillation column is warmed prior to step (iv). The warming may be by heat exchange with feed gas.

In one preferred embodiment of the invention, step (i) comprises (a) cooling the feed gas in a heat exchanger in heat exchange with the feed to the distillation column to partially condense the feed gas, (b) separating condensate from uncondensed gas, (c) expanding the uncondensed gas in the turboexpander, and (d) reducing the pressure of the condensate, e.g. by expansion through an expansion valve and recombining it with the expanded uncondensed gas.

In this embodiment, it will be understood that the recombined stream forms the stream which is then subjected to separation step (ii) of the process. The cooling of (a) condenses out heavy components from the feed gas which would otherwise condense in the expander. However, a small amount of liquid may still condense in the expander.

The liquid after separation in step (b) is desirably further cooled prior to step (d) by indirect heat exchange with the feed to the distillation column.

The warming of the feed to the distillation column which results from the indirect heat exchange of that mixture with the feed gas, and also with liquid after separation from the vapour in step (b), aids the achievement of a good temperature and heat load match between the feed gas and the product streams and reduces or eliminates the need for any supplementary refrigeration prior to the partial condensation of step (i). The warming of the feed to the distillation column can also remove the need for side reboilers in the distillation column.

In some circumstances, for example, where the pressure is high and/or the feed gas contains relatively few heavy components the feed gas may be cooled in step (i) without entering the two phase region. In such a case it may be divided into a first stream and a second stream, the first stream being fed to the turbo expander and the second stream being further cooled in indirect heat exchange with the feed to the distillation column and then reduced in pressure prior to being recombined with the first stream.

External refrigeration may be supplied to the refluxing heat exchanger to provide refrigeration at this cold end of the process. The use of external refrigeration means that a constant separation temperature can be maintained despite variations in feed gas pressure, flow or composition. Although mixed refrigerants have been proposed for NGL recovery and can be used for this process single component refrigerants can be considered because the refrigeration is required over only a small temperature range. For LPG production which usually involves liquefying only a small portion of the feedstock, and usually less than 10%, the bulk of the cooling is carried out between feed and residue gas. In such a case the majority of the external refrigeration is required at the cold end of the process where most of the liquefaction occurs and therefore a single component refrigerant is effective. Because of the low temperature level required, a cascade refrigeration system may be employed.

The use of an evaporating refrigerant rather than a gas reheating stream to condense the gas in the refluxing heat exchanger means that the temperature differences at the cold end of the process can be made smaller and thus kept nearer to reversibility. This helps to improve the overall process efficiency.

In some cases, the distillation column will be operated at a lower pressure than the preceding parts of the process to avoid approaching the critical pressure of the liquid product. It will be appreciated that one advantage of the present process over the prior art processes is that by locating the turboexpander at the warm end of the process the pressure is reduced at an early stage thus avoiding the problems associated with operating the early parts of the process near the critical pressure of the feed gas and also enabling the process to be suitable for feed gases of higher initial pressure.

The feed gas for the process will normally be supplied at a pressure of from 35 to 100 bar absolute and reduced by the turboexpander to about 30 to 60 bar absolute, preferably 35 to 50 bar absolute. However, as may be seen in Example 2, below, the process may also be applied to feed gases at higher pressures, as high as 120 bar or even higher.

Generally the pressure reduction will be as little as possible to avoid the need to expend energy in recompression of product gas but must reduce the feed gas to a pressure below the critical pressure to enable separation to take place. Maintaining the operating pressure as high as possible also helps to reduce the problem of freezing out of hydrogen sulfide and carbon dioxide when these are present in the feed gas.

In some cases the rectification of step (iii) may not be carried out by a refluxing heat exchanger but may be carried out for example, by a distillation column. Thus in its broadest aspect, the present invention provides a method for the separation of a light gas which contains methane from a feed gas stream containing heavier hydrocarbons, the method comprising:

(i) cooling the feed gas at superatmospheric pressure to partially condense it;

(ii) separating a first condensate from the uncondensed gas;

(iii) rectifying the uncondensed gas to produce said light gas and a second condensate;

(iv) stripping at least one of said first and second condensates in a distillation column to obtain an overheat stream and a liquid product stream;

wherein said cooling for step (i) includes expanding at least a part of the feed gas in a turboexpander which provides energy for compression of product gas selected from said light gas, uncondensed gas from said overhead from the distillation column and said light gas combined with uncondensed gas from said overhead.

Figure 2:
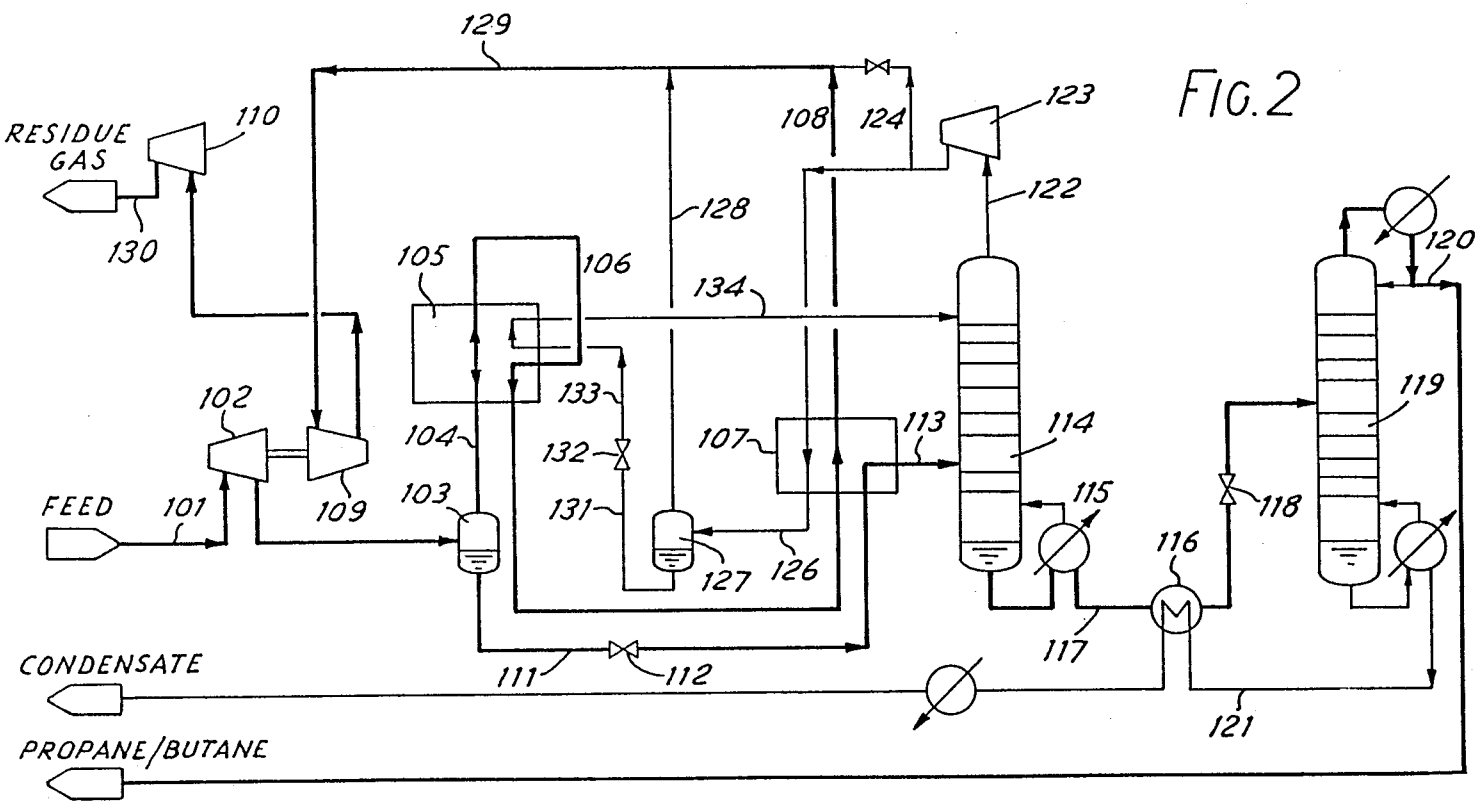

The present invention will now be described by way of example with reference to the accompanying drawings in which FIGS. 1 and 2 are flow diagrams of two alternative embodiments of the present invention.

In the process illustrated in FIG. 1 a feed gas is fed to heat exchanger 20 through line 11 at about ambient temperature. Prior to this the feed is dehydrated to prevent hydrate and ice formation at cryogenic temperatures, for example by passing through a zeolite bed. The feed is cooled in heat exchanger 20 by indirect heat exchange with returning product streams which will be described more fully below, and partially condensed. The feed leaves through line 50 as a two phase mixture and is separated in gas/liquid separator 21. The uncondensed gas in line 51 is fed to turboexpander 22 where the gas is expanded. The condensed liquid leaves separator 21 by line 52 and is further cooled in sub-cooler 23 in indirect heat exchange with a returning product stream. That liquid then leaves in line 53 where it is expanded through expansion valve 24 to a pressure similar or equal to that of the expanded gas in line 54 and then is combined with the gas in line 54 and fed to gas/liquid separator 2 in which the gas/liquid separation of step (ii) of the process of the invention is effected after gas/liquid separator 2. Uncondensed gas in line 55 is passed upwards in passages of refluxing exchanger 25 where it is further cooled initially by gas in line 61 and then by refrigerant passing through line 56. The condensate formed by this cooling descends in line 55 in direct counter-current with and in intimate contact with the rising gas and returns to the gas/liquid separator 2 where it mixes with the condensate therein to form a condensate mixture.

The condensate mixture from separator 2 is pumped by pump 9 through line 57 and heat exchangers 23 and 20 where it is warmed in indirect heat exchange with feed to near ambient temperature and is partially vaporised before being passed in line 59 to distillation column 3 where it is stabilised. In some cases, to avoid operation of the stabiliser column 3 at a pressure above or too near to the critical pressure of the liquid product, pump 9 is not required, but instead the condensate from separator 2 is reduced in pressure across valve 5 before warming in exchangers 23 and 20.

Reboil for distillation column 3 is provided by reboiler 8. In this process the heat matching of the feed and product streams is such that very little external energy is necessary for the reboil. Product propane and higher hydrocarbons leave via line 18. Overhead from the distillation column passes through line 60 to condenser 26 where it is cooled and partially condensed to provide reflux for the column.

Uncondensed gas is recovered from the reflux exchanger 25 as light gas in line 61 which contains very little propane and virtually no heavier hydrocarbons. This gas is passed back through further passages of the heat exchanger 25 at the warm end thereof and is then passed in line 64 to the condenser 26 where it is warmed in indirect heat exchange with the overhead from distillation column 3. The light gas leaves condenser 26 in line 62 and is combined with uncondensed overhead from condenser 26 and thereafter passed in line 63 to heat exchanger 20 where it is further warmed to near-ambient temperature in indirect heat exchange with feed gas in line 11. It is recovered in line 65 and thereafter recompressed in compressor 27 which is driven by turboexpander 22 and removed in line 66 as product sales gas. This sales gas may be further compressed if desired in optional compressor 28. It leaves as product sales gas in line 67.

The refrigerant in line 56 may be a mixed refrigerant or, since in this case the refrigerant is required at a single temperature level a single component refrigerant may be used.

Table 1 below gives exemplary stream compositions; temperatures, pressures and flows for the process described above.

The process of this Example is adapted to recover most of the propane and all of the heavier components in the liquid product. It will be understood that by suitable modification the process can be operated to effect a different separation and in particular to recover a liquid product with a lower ethane content. In the case of high ethane recovery in the product gas, the column top temperature will be higher and, the overhead from the column will preferably be recycled to the feed after expansion.

Table 2 below compares the power consumption for an optimised proprietary cold end expander cycle which is propane precooled with the power consumption for the process according to FIG. 1. The power consumptions are based on a feed to each process which contains 79.1% methane, 11.5% ethane and 6.8% propane and higher hydrocarbons and assuming 96% propane recovery. The feed and product sales gases are at a pressure of 70 bar a and the flow rate of the feed is 2482.5 kmol/hr (50 MMSCFD).

TABLE 1

| Composition Mol % | Line Number 11 | 18 | 51 | 54 | 57 | 61 | 62 | 64 | 66 | 67 |
|---|---|---|---|---|---|---|---|---|---|---|
| Nitrogen | 2.19 | 0 | 2.37 | | 0.30 | 2.66 | | | | 2.37 |
| Methane | 79.06 | 0.15 | 82.59 | | 37.75 | 89.38 | | | | 85.71 |
| Carbon Dioxide | 0.47 | 0.02 | 0.47 | | 0.58 | 0.44 | | | | 0.51 |
| Ethane | 11.46 | 14.51 | 10.48 | | 28.05 | 7.32 | | | | 11.20 |
| Propane | 4.08 | 50.04 | 2.98 | | 19.62 | 0.20 | | | | 0.21 |
| Butanes | 1.54 | 19.83 | 0.81 | | 7.70 | 0 | | | | 0 |
| Pentanes | 0.70 | 9.01 | 0.22 | | 3.50 | 0 | | | | 0 |
| Hexanes + | 0.50 | 6.44 | 0.08 | | 2.50 | 0 | | | | 0 |
| TOTAL | 100.00 | 100.00 | 100.00 | | 100.00 | 100.00 | | | | 100.00 |
| Temp. °C. | 43 | 43 | −18 | −47 | −46 | −67 | −18 | −53 | — | 43 |
| Pressure bar | 73.4 | 37.4 | 73.2 | 37.9 | 39.1 | 37.8 | 37.4 | — | 44.9 | 73.4 |
| Flow kmol/hr | 2482.5 | 192.8 | 2235.3 | — | 496.1 | 1986.4 | — | — | — | 2289.7 |

TABLE 2

| | | Process According to FIG. 1 | Cold Expander Cycle (Prior Art) |
|---|---|---|---|
| Refrigeration | kw | 480 | 410 |
| Recompression | kw | 1530 | 2480 |
| Expander | kw | 410 | 170 |
| Net Recompression | kw | 1120 | 2310 |
| TOTAL | kw | 1600 | 2720 |

An alternative embodiment, illustrated in FIG. 2, is adapted for use with feed gas at a significantly higher pressure. In this embodiment feed gas supplied through line 101 is cooled and partially condensed by expansion through turboexpander 102, and the resulting two phase stream is separated in gas/liquid separator 103 to provide a vapour stream in line 104 and a condensate stream in line 105.

The vapour stream is passed upwards through refluxing heat exchanger 105 where it is rectified by being cooled and partially condensed by indirect heat exchange with process stream, whose identity is more fully described below, in lines 106 and 133. The liquid condensed out of the vapour in the refluxing exchanger falls back through line 104 to mix with the condensate in separator 103. The uncondensed gas is recovered overhead in line 106, passed back in indirect countercurrent heat exchange with the rising gas stream in line 104 at the warm end of the refluxing heat exchanger, to cool the gas in line 104 and is then passed through heat exchanger 107 where it is further warmed and recovered in line 108 by which it is passed to compressor 109, driven by turboexpander 102, and supplementary compressor 110 from which it is recovered as sales gas.

The liquid from separator 103 is recovered in line 111 expanded through valve 112 where it is partially vaporised and then fed via line 113 to distillation column 114 for stripping after first giving up some cold at the warm end of heat exchanger 107. Part of the liquid recovered from the bottom of the column is returned as reboil after being heated in exchanger 115 and the remainder is warmed in heat exchanger 116 and then passed via line 117 to valve 118 where it is expanded to still lower pressure and partially vaporised and then fed to secondary distillation column 119 which is operated to recover the desired $C_3/C_4$ product overhead in line 120, heavier hdyrocarbons being removed as bottoms through line 121.

Overhead from column 114 is passed via line 122 to compressor 123 where it is recompressed. Part of the compressed gas is passed via line 124 to valve 125 where it is expanded into the sales gas stream in line 108. The remainder is supplied via line 126 to heat exchanger 107 where it is cooled and partially condensed by indirect countercurrent heat exchange with column feed in line 113 and the uncondensed gas from refluxing exchanger 105 in line 106.

The two phase mixture so obtained is separated in separator 127 and the uncondensed gas is recovered in line 128 and combined with the product gas stream in line 108 and passed via line 129 for recompression in compressors 109 and 110 and recovery in line 130. The condensate from separator 127 is recovered in line 131, expanded through valve 132 and partially vaporised and thereafter passed via line 133 through the cold end of refluxing exchanger 105 where it is further evaporated and thus provides the final cooling for the gas passing upwards through line 104. The stream recovered in line 134, which is still two-phase, is returned to the distillation column 114 as reflux.

Table 3 gives exemplary compositions, temperatures, pressures and flows for the process illustrated in FIG. 2.

In this process the total power requirements are 2060 kw for compressor 123 and 5480 kw for compressor 110, making a total of 7540 kw. All the power for compressor 109 is provided by expansion turbine 102.

TABLE 3

| Stream Name | 101 (before expander 102) FEED GAS | 101 (after expander 102) | 111 | 106 | 113 (after exchanger 107) | 122 | 117 | 117 (after valve 118) | 120 PROP/BUT PRO | 121 CON-DENSATE |
|---|---|---|---|---|---|---|---|---|---|---|
| Vapor Frac. | 1.0 | 0.82 | 0.00 | | 0.55 | 1.00 | 0.00 | 0.19 | 0.00 | 0.00 |
| Temperature (°C.) | 10 | −28 | −29 | −61 | −21 | −46 | 56 | 50 | 42 | 42 |
| Pressure (bara) | 117.2 | 49.7 | 49.7 | 49.5 | 14.5 | 14.5 | 14.3 | 12.4 | 12.8 | 12.1 |
| Molar Flow (kmol/h) | 14942 | 14942 | 3953 | 10989 | 3953 | 6669 | 1463 | 1463 | 1330 | 132 |
| Nitrogen | 0.010 | 0.010 | 0.002 | 0.013 | 0.002 | 0.002 | 0.00 | 0.000 | 0.000 | 0.000 |
| $CO_2$ | 0.050 | 0.050 | 0.055 | 0.048 | 0.055 | 0.096 | 0.00 | 0.000 | 0.000 | 0.000 |
| Methane | 0.740 | 0.740 | 0.379 | 0.870 | 0.379 | 0.526 | 0.00 | 0.000 | 0.000 | 0.000 |
| Ethane | 0.100 | 0.100 | 0.195 | 0.066 | 0.195 | 0.364 | 0.018 | 0.018 | 0.020 | 0.000 |
| Propane | 0.070 | 0.070 | 0.255 | 0.003 | 0.255 | 0.012 | 0.676 | 0.676 | 0.743 | 0.000 |

TABLE 3-continued

| | | | | | | | | | | |
|---|---|---|---|---|---|---|---|---|---|---|
| Butanes | 0.020 | 0.020 | 0.076 | 0.000 | 0.076 | 0.000 | 0.204 | 0.204 | 0.223 | 0.012 |
| Pentanes | 0.006 | 0.006 | 0.023 | 0.000 | 0.023 | 0.000 | 0.061 | 0.061 | 0.014 | 0.539 |
| $C_6$+ hydrocarbons | 0.004 | 0.004 | 0.016 | 0.000 | 0.015 | 0.000 | 0.041 | 0.041 | 0.000 | 0.449 |

| Stream | 126 | 124 | 126 (after exch 107) | 133 | 134 | 108 | 131 | 130 |
|---|---|---|---|---|---|---|---|---|
| Name | | | | | | | | RESIDUE GAS |
| Vapor Frac. | 1.00 | 1.00 | 0.16 | 0.42 | 0.71 | 1.00 | 1.00 | 1.00 |
| Temperature (°C.) | 45 | 45 | −42 | −74 | −57 | 15 | 15 | 60 |
| Pressure (bara) | 49.7 | 49.7 | 49.3 | 14.6 | 14.5 | 49.0 | 49.0 | 80.7 |
| Molar Flow (kmol/h) | 4990 | 1679 | 4990 | 4178 | 4178 | 10989 | 13479 | 13479 |
| Nitrogen | 0.002 | 0.002 | 0.002 | 0.001 | 0.001 | 0.013 | 0.011 | 0.011 |
| $CO_2$ | 0.096 | 0.096 | 0.096 | 0.101 | 0.101 | 0.048 | 0.005 | 0.055 |
| Methane | 0.526 | 0.526 | 0.526 | 0.482 | 0.482 | 0.870 | 0.820 | 0.820 |
| Ethane | 0.364 | 0.364 | 0.364 | 0.402 | 0.402 | 0.066 | 0.109 | 0.109 |
| Propane | 0.012 | 0.012 | 0.012 | 0.014 | 0.014 | 0.003 | 0.004 | 0.004 |
| Butanes | 0.000 | 0.000 | 0.000 | 0.000 | 0.000 | 0.000 | 0.000 | 0.000 |
| Pentanes | 0.000 | 0.000 | 0.000 | 0.000 | 0.000 | 0.000 | 0.000 | 0.000 |
| $C_6$+ Hydrocarbons | 0.000 | 0.000 | 0.000 | 0.000 | 0.000 | 0.000 | 0.000 | 0.000 |

We claim:

1. A method for the separation of a light gas which contains methane from a feed gas stream containing heavier hydrocarbons, the method comprising:

(i) cooling the feed gas at superatmospheric pressure to partially condense it;

(ii) separating a first condensate from the uncondensed gas;

(iii) rectifying the uncondensed gas to produce said light gas and a second condensate;

(iv) stripping at least one of said first and second condensates in a distillation column to obtain an overhead stream and a liquid product steam wherein said cooling for step (i) includes expanding at least a part of the feed gas in a turboexpander which provides energy for compression of product gas selected from said light gas, uncondensed gas from said overhead from said distillation column and said light gas combined with uncondensed gas from said overhead, said expanding being effected prior to step (ii).

2. A method as claimed in claim 1 wherein step (iii) comprises further cooling the uncondensed gas to partially condense it by supplying it to a refluxing heat exchanger wherein liquid is condensed out of said gas and flows downwards in counter-current fashion in contact with the rising gas and is recovered from the bottom of the refluxing heat exchanger as a second condensate and said light gas is recovered from the top of the refluxing heat exchanger.

3. A method as claimed in claim 2 in which at least a part of the reflux for the distillation column is provided by cooling and partially condensing overhead from said column by indirect heat exchange with said light gas.

4. A method as claimed in claim 2 in which said first and second condensates are combined to form a mixture which provides the feed to the distillation column.

5. A method as claimed in claim 2 wherein said product gas comprises said light gas combined with uncondensed gas from said overhead.

6. A method as claimed in claim 2 wherein said product gas comprises said light gas and uncondensed gas from said overhead is recycled by combining it with feed gas after that feed gas has been expanded in said turboexpander.

7. A method as claimed in claim 2 wherein step (i) is effected in part by expansion of the feed gas in said turboexpander and in part by cooling the feed gas by indirect heat exchange with product gas.

8. A method as claimed in claim 7 wherein the feed to the distillation column is warmed by indirect heat exchange with the feed gas prior to step (iv).

9. A method as claimed in claim 2 wherein said cooling of step (i) is provided by (a) cooling said feed gas in a heat exchanger in indirect heat exchange with the feed to the distillation column to partially condense the feed gas, (b) separating the liquid from the vapour, (c) expanding said vapour in said turboexpander, and (d) reducing the pressure of the liquid and recombining it with the vapour after expansion in step (c).

10. A method as claimed in claim 9 wherein said liquid after separation from said vapour and prior to step (d) is further cooled by indirect heat exchange with the feed to the distillation column.

11. A method as claimed in claim 9 wherein said product gas comprises light gas combined with uncondensed gas from said overhead, said first and second condensates are combined to form a mixture which provides the feed to the distillation column, and the light gas recovered from the refluxing heat exchanger is passed in indirect heat exchange relationship with the overhead from the distillation column to cool and condense a part of said overhead to provide reflux for said column.

12. A method as claimed in claim 2 wherein step (i) is effected entirely or substantially entirely by expansion of feed gas in said turboexpander.

13. A method as claimed in claim 12 in which the overhead from the distillation column is compressed prior to being partially condensed to provide reflux and feed to said distillation column is warmed by indirect heat exchange with said compressed overhead.

14. A method as claimed in claim 12 wherein light gas recovered from the top of the refluxing heat exchanger is warmed prior to recompression by indirect heat exchange with rising gas in the refluxing heat exchanger at the warm end of said exchanger and then by indirect heat exchange with compressed overhead from the column thereby cooling and partially condensing said compressed overhead; the partially condensed overhead thereby obtained is separated into a vapour stream and a condensate stream; reflux for said column is provided by expanding said condensate to column pressure and partially re-evaporating it by indirect heat exchange with rising gas in said refluxing heat exchanger at the cold end of said exchanger, and said vapour stream is recovered as part of said product gas.

15. A method as claimed in claim 2 wherein the distillation column of step (iv) operates at a lower pressure than step (iii).

16. A method as claimed in claim 1 for producing a product selected from natural gas liquid and liquid petroleum gas.

* * * * *